United States Patent [19]

Robinson

[11] Patent Number: 4,700,414

[45] Date of Patent: Oct. 20, 1987

[54] SOFA-SLEEPER HAVING A SNAP-IN BOTTOM-LOADING SOFA BED MECHANISM

[75] Inventor: Danny C. Robinson, Carthage, Mo.

[73] Assignee: Leggett & Platt, Incorporated, Carthage, Mo.

[21] Appl. No.: 938,585

[22] Filed: Dec. 5, 1986

[51] Int. Cl.[4] ..... A47C 17/04

[52] U.S. Cl. ..... 5/13; 5/51 B; 5/285

[58] Field of Search ..... 5/13, 51 B, 200 R, 200 C, 5/201, 282 R, 285

[56] References Cited

U.S. PATENT DOCUMENTS

| | | | |
|---|---|---|---|
| 3,247,526 | 4/1966 | Rogers, Jr. | 5/13 |
| 3,281,870 | 11/1966 | Katz | 5/13 |
| 3,854,153 | 12/1974 | Fadler et al. . | |
| 4,104,745 | 8/1978 | Pacitti | 5/13 |
| 4,106,141 | 8/1978 | Hooker | 5/201 |
| 4,225,265 | 9/1980 | Hooker et al. | 5/201 |
| 4,586,205 | 5/1986 | Stevens | 5/51 B |

*Primary Examiner*—Gary L. Smith
*Assistant Examiner*—Michael F. Trettel
*Attorney, Agent, or Firm*—Wood, Herron & Evans

[57] ABSTRACT

A sofa sleeper includes a stationary sofa frame having a front, back and opposed sides, and a sofa bed mechanism having pivotally interconnected head, body, intermediate and foot frame sections which are extendable to form a bed and foldable within the sofa frame to form a seat. The sofa bed mechanism is removably mounted to the sofa frame through the open bottom of the frame, and connectable thereto by interconnecting plate and bracket pairs, the plates being linked to the mechanism and the brackets mounted to the frame on each side thereof and releasably connectable together. The connection between the plates and brackets are provided by tapered rivets which extend from the brackets through L-shaped slots in the plates. A releasable lock holds the plates and brackets in connected position.

12 Claims, 7 Drawing Figures

SOFA-SLEEPER HAVING A SNAP-IN BOTTOM-LOADING SOFA BED MECHANISM

This invention relates to sofa-sleepers, and more particularly, to a snap-in connection between the foldable sofa bed mechanism and the stationary sofa frame of a sofa-sleeper which permits attachment and removal of the mechanism through the frame bottom.

Foldable sofa-sleepers are adapted to mount on a stationary sofa frame and include a foldable sofa bed mechanism having pivotally interconnected head, body, intermediate and foot frame sections. The stationary sofa frame of prior sofa-sleepers is generally formed with a backrest cushion, a pair of side rails, and a fixed front rail which define a generally rectangular storage enclosure for the folded sofa bed mechanism. The frame sections of the sofa bed mechanism are movable between a fully folded or retracted position within the sofa frame and an extended position wherein the sections extend out and over the front rail of the sofa frame to form a bed.

In prior sofa-sleepers, as for example the sofa-sleeper of U.S. Pat. No. 3,854,153, the foldable sofa bed mechanism is generally mounted to the stationary sofa frame by a pair of opposed angles connected to the head and body frame sections of the sofa bed mechanism and attached to the side rails of the sofa frame. The mounting angles are usually riveted or pinned to the head and body frame sections of the sofa bed mechanism and are essentially permanently fixed to the side rails of the sofa frame by screws, bolts, nails or similar connectors.

A problem with such a prior art connection between the sofa bed mechanism and sofa frame is that it is essentially permanent and does not permit easy disassembly of the sofa bed mechanism from the sofa frame for repair of the upholstered portions of the sofa frame or any part of the sofa bed mechanism. Sofa sleepers have been provided with removable sofa bed mechanisms, such as that of U.S. Pat. No. 4,586,205. Such a mechanism as shown in that patent is removable through the open top of the frame.

Assembly of a sofa-sleeper or removal of a sofa bed mechanism of a sofa-sleeper through the open top of the frame generally occurs when the frame is fully upholstered. Accordingly, there is risk of soiling or tearing the exposed upholstery fabric. On the other hand, assembly and removal of the sofa bed mechanism through the bottom of the frame necessitates movement of the mechanism in the direction in which movement must normally be prevented for the mechanism to support its own weight or a load when in use. Accordingly, the means for attachment of the mechanism must selectively latch or lock the mechanism in place and be positive, strong and secure.

It has been a general objective of this invention to provide a sofa-sleeper having a releasable mounting arrangement between the foldable sofa bed mechanism and stationary sofa frame to permit disassembly of the sofa-sleeper through the bottom of the sofa frame for assembly or for repair or replacement of either the sofa bed mechanism or the sofa frame.

It has been another objective of the present invention to provide a snap-in removable sofa bed mechanism in a sofa-sleeper which will enable attachment and removal of the mechanism through the bottom of the frame. It has been a more particular objective of the present invention to provide a removable snap-in sofa bed mechanism which effectively resists downward movement when attached to the frame, and which securely locks the mechanism and frame together in assembled condition.

The sofa-sleeper of this invention which accomplishes these objectives comprises a foldable sofa bed mechanism and a stationary sofa frame. The sofa frame includes front, back and opposed side rails forming a generally rectangular enclosure, which are preferably formed of wood. The sofa bed mechanism includes pivotally interconnected head, body, intermediate, and foot frame sections which are extendable to form a bed and foldable within the sofa frame to form a seat. The sofa bed mechanism is removably mounted upon the stationary sofa frame by mating brackets and mounting plates. A pair of brackets are mounted to the sofa frame, one on the interior surface of each of the opposed side rails. A mounting plate is pivotally connected on opposite sides of the sofa bed mechanism to members of the head and body frame sections. The mounting plates of the sofa bed mechanism are adapted to snap onto the sofa frame brackets from beneath for removably mounting the mechanism upon the sofa frame as the mechanism is inserted into the frame from the bottom. Preferably, means are provided for releasably locking the mounting plates in place or the brackets upon insertion of the mechanism within the frame.

The brackets and mounting plates are formed of bars stamped from heavy sheet material. Attachment of the mechanism to the frame is achieved with a snap-in connection between the plates and brackets. To accommodate assembly and disassembly from the bottom of the frame, the lower edges of the brackets or the upper edges of the plates are adapted to make the connection. According to the present invention, one of these edges, preferably that of the plate, is provided with two or more L-shaped slots which slide onto a set of rivets or other type of pins on the other bar. The attachment motion is first vertical and then horizontal until the pins reach the ends of the slots. In a specific provision of one aspect of the invention, the pins have tapered heads to guide and hold each plate and bracket pair together. When fully attached, the mechanism will not drop back out of the frame.

In the preferred embodiment of the invention, a lock is provided to secure the bracket and plate in the assembled position. Specifically, each of the mounting plates is further provided with an outwardly extending tab near one end which is adapted to snap-fit within a mating notch formed in each bracket. The tab and notch connection releasably locks the mounting plates in place upon the brackets so that the pins will nto move in the L-shaped slots and, thus, the sofa bed mechanism will remain secured in place within the sofa frame.

In addition, additional hooks are provided to trap the edge of the mounting plates against the frame to stiffen the plate and reduce its tendency to buckle or otherwise deform under load.

The structure, operation and advantages of this invention will become further apparent upon consideration of the following description taken in conjunction with the accompanying drawings in which.

Figure 1:
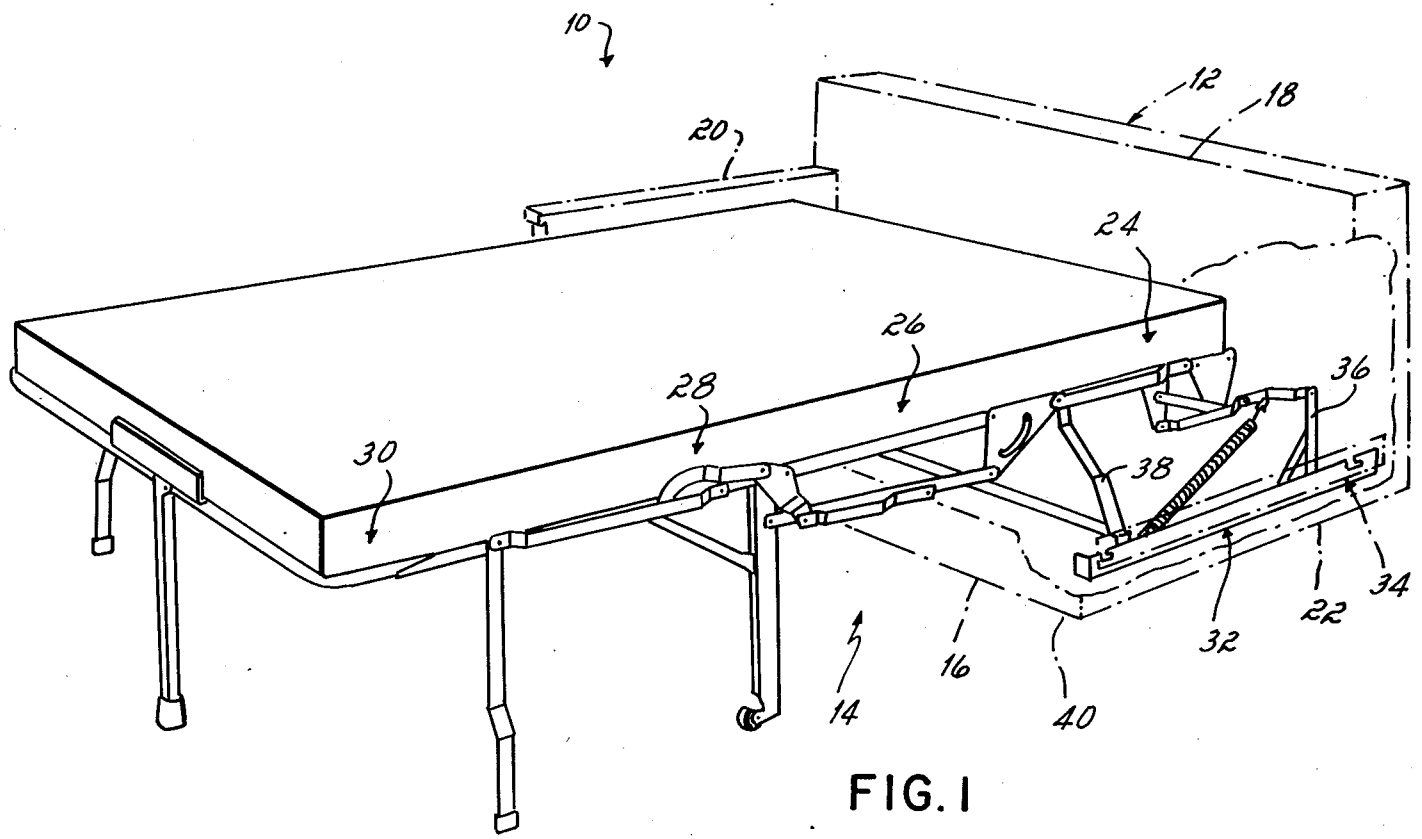
FIG. 1 is a perspective view of a sofa-sleeper incorporating the connection between the sofa bed mechanism and sofa frame of this invention.

Referring now to FIG. 1, a sofa-sleeper 10 comprises a stationary sofa frame 12 and a foldable sofa bed mechanism 14. The sofa frame 12 is a standard upholstered frame preferably formed of wood and including a front rail 16, back rest cushion 18, and opposed side arms 20 and 22. The sofa bed mechanism 14 includes a pivotally interconnected and transversely arranged bed frame head section 24, a body section 26, an intermediate section 28, and a foot section 30. The pivotal connections and foldable operation of the sofa bed mechanism 14 form no part of this invention and may comprise any well-known standard sofa bed mechanism construction, such as shown in U.S. Pat. No. 3,854,153.

The sofa bed mechanism 14 is removably mounted within the sofa frame 12 by a pair of opposed mounting plates 32 pivotally attached thereto. These are adapted to be releasably connected to a pair of opposed brackets 34 secured to the interior surface 21 of side arms 20 and 22 of the sofa frame 12 as described below. Only one of the mounting plates 32 and brackets 34 is shown in FIG. 1, it being understood that identical but opposite elements are provided on the opposite side of the mechanism 14 and on the opposite side arm 20 of the frame 12.

The mounting plate 32 is pivotally connected to the sofa bed mechanism 14 by a rear hanger arm post 36 forming part of the head frame section 24, and a main pilot arm 38 which forms a part of the body frame section 26 of sofa bed assembly 14. The structure and operation of the hanger arm post 36, the main pilot arm 38, and the remainder of sofa bed assembly 14 is described in detail in prior patents of the assignee, such as U.S. Pat. No. 3,854,153.

In FIG. 1, the sofa bed mechanism 14 is shown inserted into the frame 12 with the sofa bed mechanism 14 in the extended condition. The mechanism 14 is not intended to be attached to or removed from the frame 12 in the extended condition according to the present invention. Rather, it is contemplated that the bed mechanism 14 will be removed from the frame 12 when the mechanism 14 is folded. The frame 12, in conventional sofa-sleeper construction, has an open bottom 40. According to the present invention, the mechanism 14 is removable from and attachable to the frame through the open bottom 40 of the frame 12. This is better illustrated with reference to FIGS. 2–7 described below.

The insertion and removal of the sofa bed mechanism 14 from the frame 12 is accomplished by turning the sofa-sleeper upside-down and accessing the interior of the frame 12 through the open bottom 40. The mechanism 14 and the frame 12 are attached and detached through the interaction of the plate 32 and the bracket 34. This is shown in detail in FIG. 2.

Figure 2:
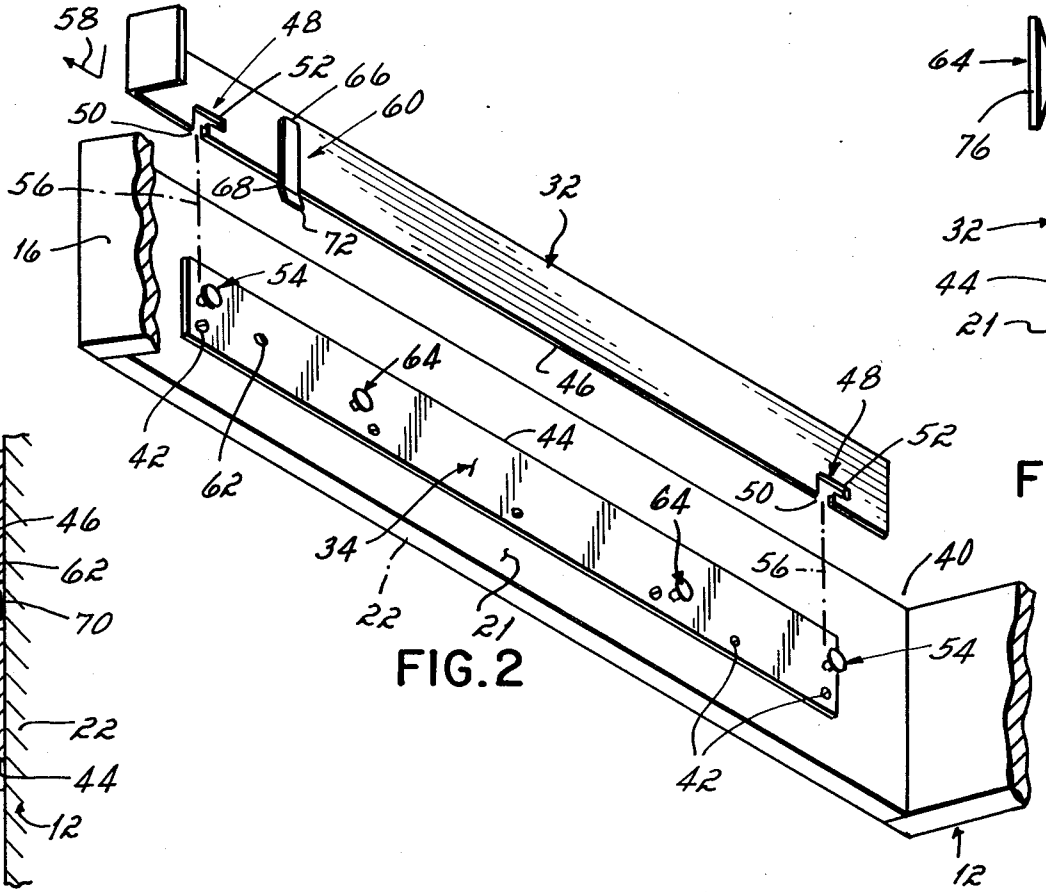
FIG. 2 is an exploded upside-down perspective view showing the connection between the plate and bracket.

Referring to FIG. 2, a cutaway perspective of a portion of the frame 12 is presented. This is shown with the sofa-sleeper in the upside-down position presenting the open bottom 40 of the frame 12 accessible from the top.

In FIG. 2, the bracket 34 is shown attached to the side 22 of the frame 12. The bracket 34 is formed of an elongated bar of sheet metal and is nailed or screwed at several points 42 to the wooden framing of the frame side 22. The bar of bracket 34 has a normally downwardly facing edge 44 facing the open bottom 40 of the frame 12. The mounting plate 22 is also formed of an elongated bar. This bar has an upwardly facing edge 46 which, when the mechanism 14 is positioned for assembly prior to insertion into the frame 12, faces upwardly and into the open bottom 40 of the frame 12.

In the illustrated embodiment of the invention, connection between the plate 32 and the bracket 34 is achieved by provision of a pair of L-shaped slots 48 in the upwardly facing edge 46 of the bar which forms the plate 32. These slots each have a vertical leg 50 which is perpendicular to the horizontal upwardly facing edge 46, and a horizontal leg 52, which is parallel to the horizontal edge 46. A mating connector is carried by the bar of the bracket 34 in the form of wide-headed pins 54, preferably tapered rivets, which extend horizontally and transversely from the inner surface of the bar of the bracket 34. The slots 48 are spaced a prescribed distance along the horizontal upwardly facing edge 46 of the bar of the plate 32. The pins 54 are spaced a similar horizontal distance on the inner surface of the bar of bracket 34.

In the process of assembly of the mechanism 14 to the frame 12, the mechanism 14 is aligned such that the plate 32 and bracket 34 are parallel, and the slots 48 are vertically aligned with the pins 54. This is shown by the lines 56 in FIG. 2. For assembly, the mechanism is lowered through the upwardly facing bottom 40 of the frame 12 such that the plates 32 and brackets 34 join together with the slots 48 slipping over the pins 54. In assembly, the plates 32 descend vertically and then slide horizontally as shown by the arrow 58 such that the pins 54 slide first into the upward vertical legs 50 of the slots 48 and then horizontally along the horizontal legs 52 of the slots 48.

Also provided on the bar of the plate 32 is a spring detent 60. This detent functions in cooperation with a hole or notch 62 in the bar of the bracket 34. The hole 62 is positioned in the bracket 34 such that the tip of the detent 60 will coincide with the drop into the notch 62 when the pins 54 are positioned at the extreme interior ends of the horizontal leg 52 of the slots 48. It thus locks each bracket 34 and plate 32 together in that position. Locked in this position, the slots 52 and pins 54 operate to hold the mechanism 14 in the frame 12 as the frame is inverted to its upright position and will hold the mechanism 14 within the frame 12 to prevent it from dropping out of the open bottom 40, thereby supporting a load on the seat formed when the mechanism 14 is in the folded condition.

The bracket 34 is also provided with one or more hooks 64. The hooks 64 are also formed by rivets having wide heads which form the curl of the hook. The hooks 64 are positioned in this case, intermediate of the pins 54 to engage the upwardly facing edge 46 of the plate 42 and support it against buckling or other deformation which could occur as loads are applied to the mechanism 14 when in use. The details of the connecting and locking elements will be better understood with reference to FIGS. 5–7 below and the description relating to those figures.

According to the broader principles contributed by the present invention, the slots 48 could be carried by the bar of the bracket 34, rather than by the bar of the plate 32. In such a design, the slots 48 will be reversed in orientation and formed in the downwardly facing edge 44 of the bar bracket 34. Correspondingly, the respective pin 54 for each such slot 48 would be carried by the bar of the plate 32, rather than the bar of the bracket 34. However, advantages in fabrication and assembly are achieved by the illustrated embodiment, which shows the slots 48 formed in the plate 32, and such advantages will be apparent to those skilled in the art of fabrication and assembly of such components. Similarly, the hooks 64, as well as the detent 60 and notch 62, may be carried by the opposite bar from that of the plate 32 or bracket 34 shown in the illustrated embodiment. But here, too, the preferred embodiment is illustrated and is believed to be the more advantageous alternative in most circumstances.

Figure 3:
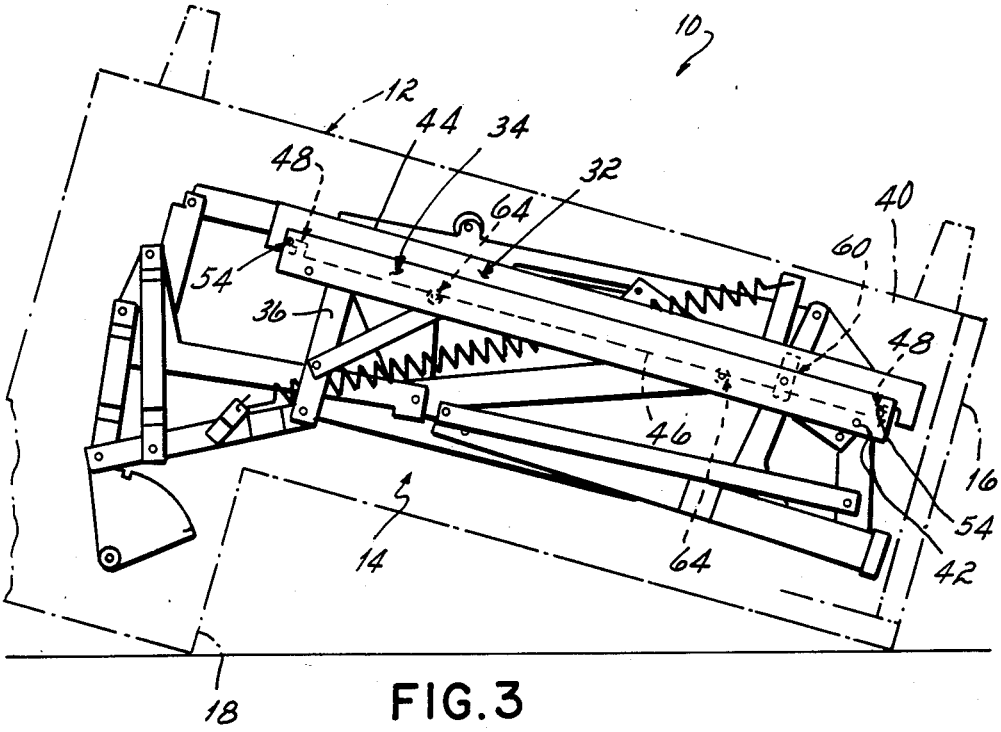
FIG. 3 is a side elevational view of the sofa bed according to the invention oriented bottom side up for assembly or removal of the sofa bed mechanism through the bottom of the frame. The mechanism is shown in solid lines and the frame in phantom.

Following assembly or prior to disassembly, the sofa bed 10 is shown oriented upside-down for attachment or removal of the mechanism 14 from the frame 12 in FIG. 3. The frame 12 is shown in phantom with its front section 16 and back section 18 and side section 22 are positioned as indicated. The open bottom 40 of the frame 12 is facing upward in this orientation. It is through this open bottom 40 that the entire mechanism 14, when in its folded condition, can be easily inserted. In this way, the mechanism 14 can be inserted or removed without risk of damage to the upholstery covering the frame 12. The mechanism 14 shown in FIG. 3 is conventional and will not be further described here. However, this mechanism is fully described in U.S. Pat. No. 3,854,153 to which reference may be made for further details.

In FIG. 3, the bracket 34 is shown positioned as it would be when secured to the side 22 of the frame 12. The mounting plate 32 is shown positioned as it would be attached to the bracket 34 with the pins 54 fully inserted within the slots 48, in which position they are locked through the spring detent lock 60, which is in engagement with the notch position at 62 in the bracket 34. The linkages 36 and 38 through which the mounting plate 32 is pivotally attached to the mechanism 14 are illustrated in the positions they will assume when the mechanism 14 is in the folded condition shown in FIG. 3.

Figure 4:
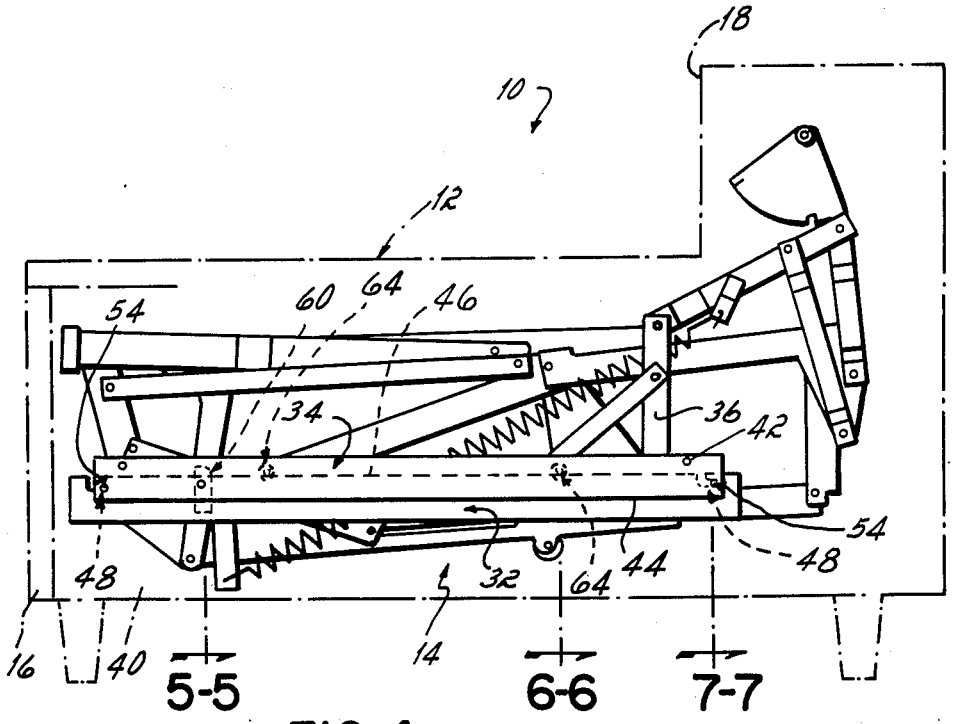
FIG. 4 is a drawing similar to FIG. 3 showing the sofa bed in upright position.

FIG. 4 shows an identical presentation of the sofa-sleeper 10 as was shown in FIG. 3, but with the sleeper 10 in its upright orientation. Hereto, the frame 12 is illustrated in phantom, and the mechanism 14 is shown in elevation in its folded condition within the frame 12.

Figure 5:
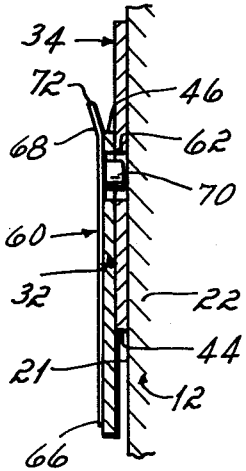
FIG. 5 is a cross-sectional view along the line 5—5 of FIG. 4 showing the lock.

The details of the locking mechanism comprised of the detent 60 and notch 62 are better shown by reference to FIG. 5. Similarly, the details of the hooks 64 are better shown by reference to FIG. 6. Further, the details of the pin and slot combination 54 and 48, respectively, are better shown by reference to FIG. 7.

Referring to FIG. 5, the bar of the mounting plate 32 and the bar of the bracket 34 are shown in cross section. In the bar 34 is the hole or notch 62. The spring loaded detent 60 is rigidly secured at point 66 to the inside of the bar of the mounting plate 32. A spring metal arm 68 extends from the point 66 upwardly and has welded to the upper end thereof a plug or pin 70. The upper end 72 of the spring metal portion 68 of the detent mechanism 60 is formed so that it can be manually engaged to withdraw the plug 70 from the hole 62 to release the lock. Otherwise, when properly positioned, the spring metal arm 68 urges the plug 70 into the notch 62 to lock the bars of the plate 32 and bracket 34 together in their assembled position.

Figure 6:
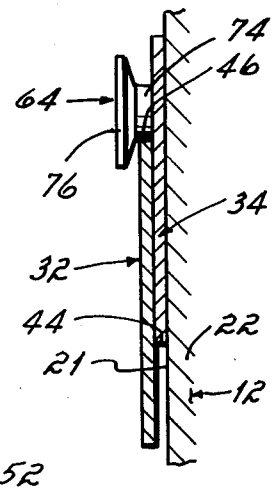
FIG. 6 is a cross-sectional view along line 6—6 of FIG. 4 showing a tapered headed rivet used as a guide hook to support the edge of the mounting plate.

Referring to FIG. 6, the hook 64 is illustrated as formed by a rivet having a shaft 74 and a widened tapered rivet head 76. The rivet is secured to the bar of the bracket 34. It is positioned so that when the plate 32 is assembled against the bracket 34, the head 76 hooks over the upper edge 46 of the bar of the plate 32 and, with its tapered underside, to wedge it against the bar of the bracket 34 to hold the plate 32 flat against the side of the frame.

Figure 7:
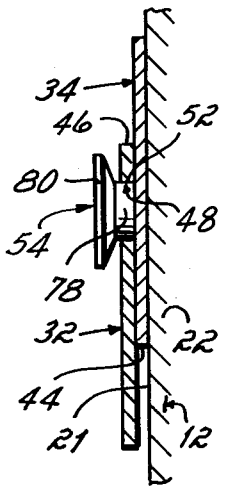
FIG. 7 is a cross-sectional view along line 7—7 of FIG. 4 showing a tapered headed rivet used as a pin to engage the slot.

In FIG. 7, the connection between the bar of the bracket 34 and the bar of the plate 32 is shown. The slot 48 is shown at a cross section of its horizontal leg 52 through which the pin 54 extends. The pin 54 is also formed of a rivet secured to the bar of the plate 34 which also has a shaft 78 and tapered head 80. The underside of the tapered head 80 operates to guide the pin 54 into the slot 48 as the mechanism 14 is inserted into the frame 12 and also to pull the bar of the plate 32 more securely against the bar of the bracket 34 once the shaft 78 of the pin 54 is within the slot 48.

The preferred embodiment of the present invention having been described above, the following is what is claimed:

1. A sofa-sleeper comprising:

a stationary sofa frame having front, back and opposed sidewalls, each of said sidewalls having an interior surface, a sofa bed mechanism having pivotally interconnected head, body, intermediate and foot sections, said mechanism being extendable to form a bed and foldable within said frame to form a seat, two sofa bed mechanism support brackets, each mounted on the interior surface of one of said sidewalls, two mounting plates, each pivotally connected to said head and body frame sections at a different side of said mechanism, each of said plates having an upwardly facing edge, each of said plates having a horizontally spaced pair of L-shaped slots in the upwardly facing edge thereof, each of said brackets having a horizontally spaced pair of wide-headed pins extending therefrom and through said slots, whereby said mechanism when folded is removably connectable to said frame through the bottom thereof.

2. The sofa-sleeper of claim 1 wherein said pins are rivets having heads which tape outwardly toward the ends thereof.

3. The sofa-sleeper of claim 1 wherein said brackets each have at least one hook extending therefrom positioned to engage said upwardly facing edge of said mounting plates.

4. The sofa-sleeper of claim 3 wherein each of said hooks is a rivet having a head which tapers outwardly toward the end thereof.

5. The sofa-sleeper of claim 1 wherein each of said slots has a vertical and horizontal leg, and wherein each of said brackets has a notch formed therein, and wherein each of said mounting plates has a snap-action detent positioned thereon and adapted to engage said notch to lock the bars together when said pins are fully inserted in said slots at the ends of the horizontal legs thereof.

6. The sofa-sleeper of claim 5 wherein said pins are rivets having heads which taper outwardly toward the ends thereof, and wherein each of said brackets has a plurality of horizontally spaced rivets having heads which taper outwardly toward the ends thereof positioned to engage the upwardly facing edges of the bars of said mounting plates.

7. A sofa-sleeper comprising:

a stationary sofa frame having front, back and opposed sidewalls, each of said sidewalls having an interior surface, a sofa bed mechanism having pivotally interconnected head, body, intermediate and foot sections, said mechanism being extendable to form a bed and foldable within said frame to form a seat, two sofa bed mechanism support brackets, each mounted on the interior surface of one of said sidewalls, each of said brackets being formed of an elongated bar having a downwardly horizontal facing edge, two mounting plates, each pivotally connected to said head and body frame sections at a different side of said mechanism, each of said plates being formed of an elongated bar having an upwardly facing horizontal edge, each of said bars forming a corresponding pair of bars on each side of said sofa-sleeper with one of the bars which forms said brackets, said bars of each of said pair having a plurality of L-shaped slots each in one of said edges thereof, and having the same plurality of wide-headed pins each in the other of said bars opposite one of said slots and extending therethrough, whereby said mechanism when folded is removably connectable to said frame through the bottom thereof.

8. A sofa-sleeper of claim 7 wherein one of the bars of each of said pair has a plurality of L-shaped slots spaced along the horizontal edge thereof, and the other of the bars of each of said pair has the same plurality of similarly spaced wide-headed pins extending therefrom and through said slots.

9. The sofa-sleeper of claim 7 wherein one of the bars of each of said pair has a plurality of horizontally spaced hooks extending therefrom and positioned to engage said edge of the other bar of said pair.

10. The sofa-sleeper of claim 9 wherein said pins are rivets having heads which taper outwardly toward the ends thereof, and wherein said hooks are rivets having heads which taper outwardly toward the ends thereof.

11. The sofa-sleeper of claim 7 wherein each of said slots has a vertical and horizontal leg, and wherein one of the bars of each of said pair has a snap-action lock positioned thereon and adapted to lock the bars together when said pins are fully inserted in said slots in the horizontal legs thereof.

12. The sofa-sleeper of claim 11 wherein said snap-action lock comprises a spring detent in one of said bars of each pair and a notch in the other of said bars of each pair and positioned to receive the end of said detent to lock said bars together.

* * * * *

UNITED STATES PATENT AND TRADEMARK OFFICE

CERTIFICATE OF CORRECTION

PATENT NO. : 4,700,414

DATED : October 20, 1987

INVENTOR(S) : Danny C. Robinson

It is certified that error appears in the above-identified patent and that said Letters Patent is hereby corrected as shown below:

Column 2, line 53, change "nto" to --not--.

Column 4, line 11, change "22" to --32--.

Column 6, line 55, change "tape" to --taper--.

Signed and Sealed this

Sixth Day of December, 1988

*Attest:*

DONALD J. QUIGG

*Attesting Officer*

*Commissioner of Patents and Trademarks*